United States Patent [19]

Hanson et al.

[11] 4,173,378

[45] Nov. 6, 1979

[54] REFRIGERATOR SEALED FOOD STORAGE DRAWER

[75] Inventors: Robert S. Hanson, Kettering; Paul E. Kronenberger; Charles C. Whistler, Jr., both of Dayton, all of Ohio

[73] Assignee: White Consolidated Industries, Inc., Cleveland, Ohio

[21] Appl. No.: 929,347

[22] Filed: Jul. 31, 1978

[51] Int. Cl.[2] ..... A47B 88/04

[52] U.S. Cl. ..... 312/296; 62/382; 312/270; 312/330 R

[58] Field of Search ..... 312/296, 270, 330 R, 312/116, 291, 122, 214, 236; 62/382

[56] References Cited

U.S. PATENT DOCUMENTS

| | | | |
|---|---|---|---|
| 2,689,778 | 9/1954 | Chambers et al. | 312/270 |
| 3,266,858 | 8/1966 | Klotz | 312/270 |
| 3,680,941 | 8/1972 | Shanks | 312/296 |
| 3,998,069 | 12/1976 | Kronenberger et al. | 62/382 |
| 4,013,434 | 3/1977 | Kronenberger et al. | 62/382 |

*Primary Examiner*—Mervin Stein
*Assistant Examiner*—Alex Grosz
*Attorney, Agent, or Firm*—Pearne, Gordon, Sessions

[57] ABSTRACT

A supporting frame and cover panel assembly adapted for slidably and sealingly supporting a food storage drawer in a generally airtight sealed environment for extended food storage. The assembly includes a rectangular one-piece frame supporting a cover panel in a locked manner by a pair of trim members. A seal, suitably affixed in the side members and a rearward member, are substantially coextensive therewith such that the seal extends into a path of the drawer when the drawer is moved from its open position to its closed position, whereby when the drawer is in its closed position the seal abuts the side and rear walls of the drawer. The front cross frame member includes means for effecting a sealed relationship with the front wall of the drawer when the drawer is in its closed position to complete the generally airtight sealed environment for the food in the drawer.

1 Claim, 6 Drawing Figures

REFRIGERATOR SEALED FOOD STORAGE DRAWER

This invention relates to refrigerator cabinet storage drawer construction and more particularly to a removable sealed storage drawer and support cover for installation in various locations in the refrigerator cabinet.

One type of food storage drawer, having a sealed environment to preserve articles within the refrigerator fresh food compartment, is disclosed generally in U.S. Pat. No. 3,680,941 to Harry R. Shanks, issued Aug. 1, 1972. The Shanks patent discloses a refrigerator food storage compartment comprising an outer boxshaped housing arranged to be contained wholly within the refrigerator, having a forward opening. The marginal edge portions surrounding the opening carry a gasket of elastomeric material. A drawer is slidably received in the housing and includes a forward wall having marginal edge portions arranged to abut the gasket to effect substantial sealing engagement between the drawer and housing. The Shanks patent is in effect a drawer within a boxlike outer housing designed to maintain foods in fresh moist condition for extended periods of time.

It is an object of the present invention to provide an improved sealed food storage drawer for location within a refrigerator fresh food compartment by means of a supporting frame and cover panel assembly adapted for slidably supporting a flanged, imperforate open-top food storage drawer between an open position outside the frame providing access to unwrapped food therein and a closed position inside the frame providing a generally airtight sealed environment for the unwrapped food. The assembly includes a rectangular one-piece frame, a cover panel of similar rectangular shape and a pair of trim members for affixing the cover panel in the frame. The frame comprises elongated mirror image side frame members interconnected at their ends by front and rear cross frame members providing first inwardly facing channels adjacent the top of the side frame members and extending throughout the length thereof for slidably receiving opposite sides of the cover panel. Shoulder means on the front cross member abut the cover panel as it is slidably received in the first channel for positioning the panel in the frame. Second inwardly facing channels in the side frame members are substantially coextensive with and spaced below the first channels such that the second channels are adapted to provide sliding support for an associated flange of the drawer. A third outwardly facing channel is located intermediate the first and second channels. An inwardly facing groove, adjacent the bottom of the side frame members, is configured for receiving and affixing one portion of a seal with the drawer. Each of the pair of trim members has a generally C-shaped section formed by upper and lower legs with each leg overlapping an upper face of its associated side frame member and each lower leg overlapping an upper wall portion of its associated third channel in a manner for grippingly retaining the trim member in a fixed relationship thereto. The upper leg of at least one trim member including an initially extended integral stop tab portion operative upon being downwardly bent into an interfering relationship with the rearward travel of the cover panel in the first channels serves to lock the cover panel in the frame after the shoulder means has positioned the panel in the frame. The seal support member on the rear cross frame member defines a forwardly facing groove in substantial alignment with the grooves on the side frame members and is configured for receiving and affixing another portion of the seal for the drawer. Upon a seal being affixed in a coextensive manner in the grooves of the side members and the seal support member extends into the path of the drawer. Thus, when the drawer is moved from its open position to its closed position, the seal abuts the side and rear walls of the drawer in a manner to partially form a generally airtight seal therewith. The frame front cross frame member includes means for effecting a sealed relationship with the front wall of the drawer when the drawer is in its closed position, thereby completing the generally airtight sealed environment permitting food to be stored overnight or up to two weeks depending on the kind of food and its quality in the drawer without wrappings or coverings.

Further objects and advantages of the present invention will be apparent from the following description, reference being had to the accompanying drawings wherein a preferred embodiment of the present invention is clearly shown.

Figure 1:
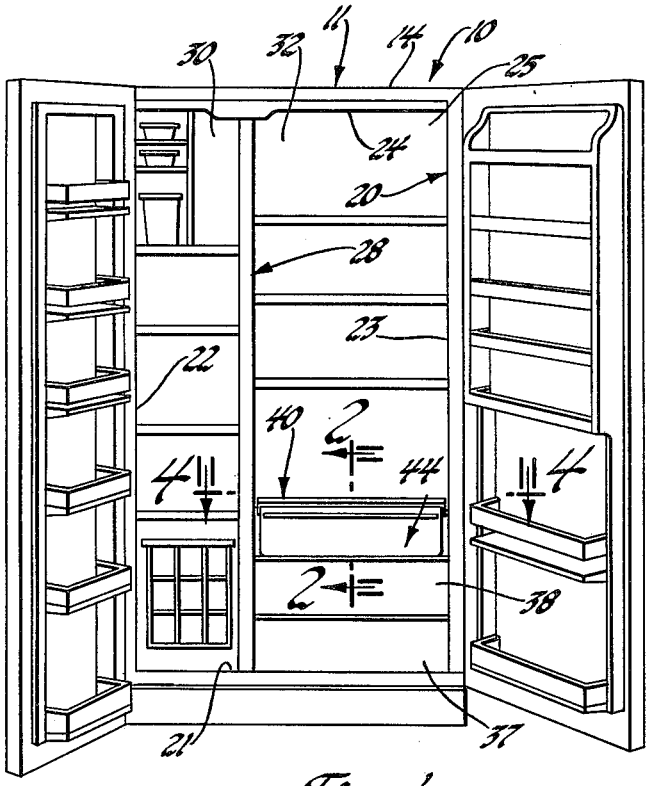
FIG. 1 is a perspective view of a side-by-side refrigerator incorporating the present invention, with the refrigerator doors shown in their open position.

Referring now to the drawings, for the purpose of illustrating the invention, there is shown in FIG. 1 thereof an insulated side-by-side refrigerator cabinet, generally represented by the reference character 10 including a continuous outer sheet metal shell 11 forming outer side walls (not shown) and outer top wall 14. The interior of the cabinet is provided with one-piece box-shaped inner liner 20 preferably formed out of a suitable sheet plastic such as acrylic butadiene styrene (ABS) copolymer having a bottom wall 21, side walls 22 and 23, top wall 24 and rear wall 25. Suitable insulation, such as foam insulation 26 (FIG. 4), is provided between the outer shell 11 and the plastic liner 20. The liner is divided by means of a vertically extending partition 28, into a freezer compartment 30 and a fresh food or above-freezing compartment 32. As partially indicated in FIG. 5, the partition 28 has spaced apart walls, one of which is shown at 34 with foam insulation 36 provided therebetween. The fresh food compartment is shown with a plurality of separate drawer-type compartments. These may include a cold meat-tender 37 such as shown in U.S. Pat. No. 3,108,455 issued Oct. 29, 1963, to R. S. Hanson, and a hydrator drawer 38 of the type shown in U.S. Pat. No. 4,013,434 to Kronenberger, et al; both of which are assigned to the same assignee as the present application.

Figure 4:
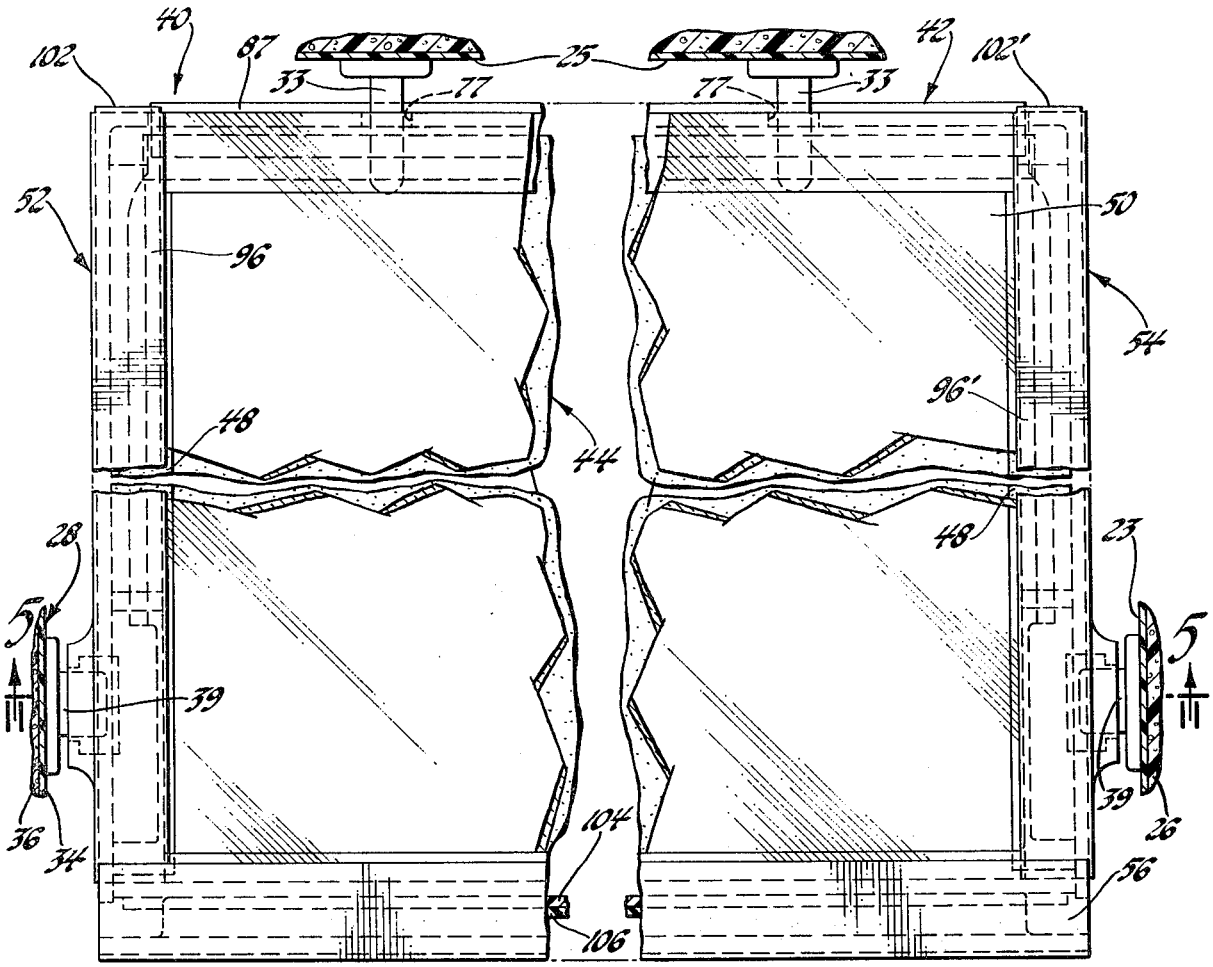
FIG. 4 is an enlarged fragmentary vertical plane view, partly in section, taken substantially on the line 4—4 of FIG. 1.
Figure 5:
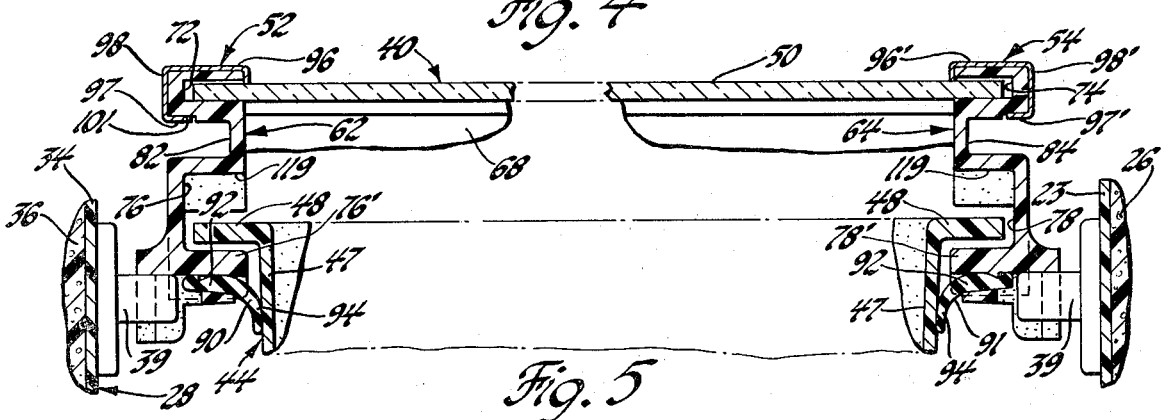
FIG. 5 is an enlarged fragmentary vertical sectional view taken substantially on the line 5—5 of FIG. 4.

As shown in the drawings a sealed food storage drawer supporting frame and cover panel assembly, generally indicated at 40, is shown in the present embodiment supported in spaced relation above the drawers 37 and 38 of the refrigerator food compartment 32 by a suitable means, such as by rear wall supporting pegs or studs and side wall supporting studs shown at 33 and 39 respectively, in FIG. 4 and described in detail in U.S. Pat. No. 3,649,059 to J. W. Davidson and assigned to the assignee of the present invention.

The food storage drawer supporting frame and cover panel assembly 40 includes a rectangular one-piece frame 42 molded of suitable plastic material, preferably impact polystyrene. The supporting frame 42 is adapted to slidably support a food container drawer 44 preferably molded of plastic material such as modified acrylic having a front wall 45, a rear wall 46 and side walls 47 with side flanges 48 and rear flange 49 flared outwardly from the upper edges of the sidewalls 47 and rear wall 46, respectively. The drawer 44 is thus carried or suspended from opposed trackways or channels of the support frame 42. The imperforate open top food storage drawer 44 is thus movable between an open position outside the frame 42 to provide access to the food therein and a closed position inside the frame to provide a generally airtight sealed environment for the food therein in a manner to be described. The assembly 40 further includes a cover panel 50 which in the preferred embodiment is a glass pane of similar rectangular shape as the frame. A pair of side trim members 52 and 54 are included in the assembly and are operative for fixing or locking the cover panel 50 in the frame. A decorative front trim member 56 is provided on the frame to be described.

Figure 2:
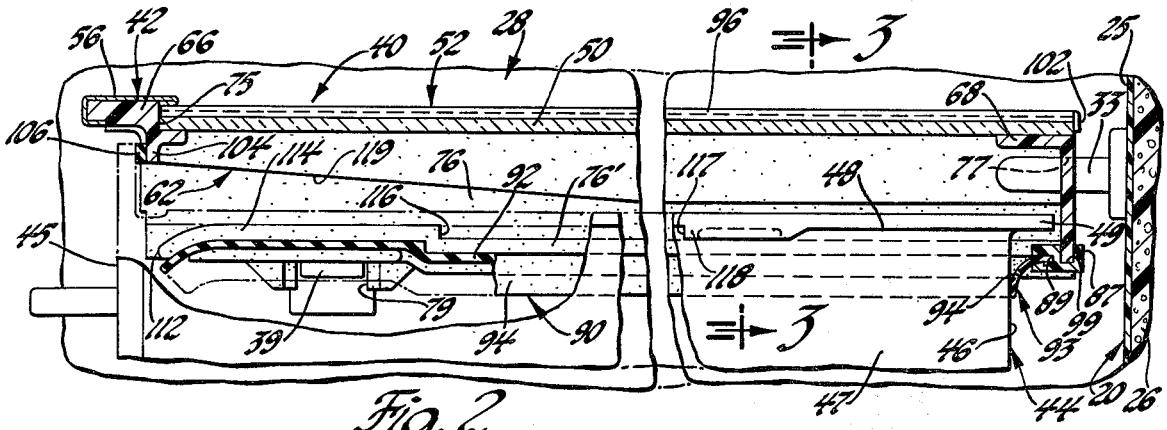
FIG. 2 is an enlarged fragmentary vertical sectional view taken substantially on the line 2—2 of FIG. 1.
Figure 3:
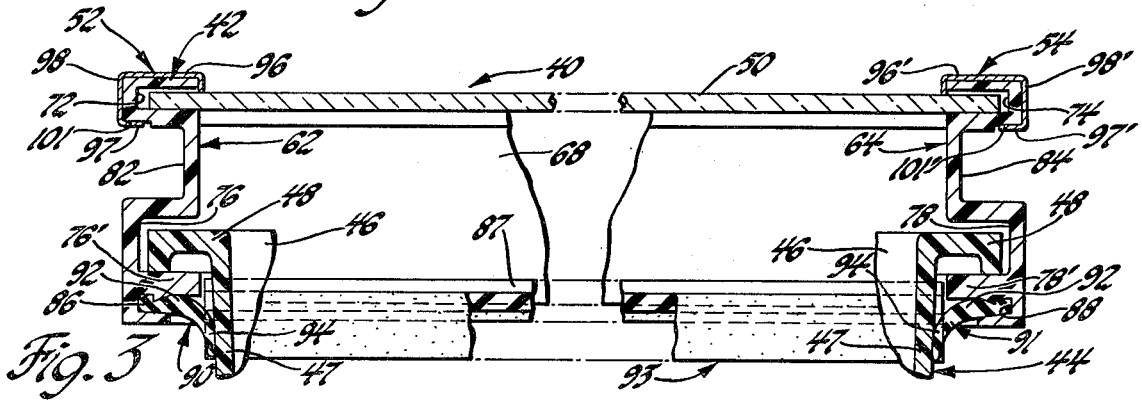
FIG. 3 is an enlarged fragmentary vertical sectional view taken substantially on the line 3—3 of FIG. 2.

With reference to FIGS. 2–5, the one-piece frame 42 comprises elongated mirror image frame side members 62 and 64 interconnected at their ends by front 66 and rear 68 frame cross members. As best seen in FIG. 3, each of the frame side members 62, 64 defines first inwardly facing channels 72, 74 respectively, adjacent the top thereof and extending throughout the length of the members 62, 64 for slidably receiving opposite sides of the cover panel 50 therein. As viewed in FIG. 2, shoulder means 75 defined by the rear face of the front cross member 66 abuts the cover panel front edge as it is slidably received in the first channels 72, 74 positioning the cover panel in the frame. It will be noted that the rear cross member 68 has apertures 77 for receiving the rear studs 33 while the side members have arch-like embossments 79 (FIG. 6) for engaging the side studs 39.

FIGS. 2–5 disclose means defining second inwardly facing channels 76, 78 in the frame side members 62, 64 respectively substantially coextensive with and spaced below the first channels 72 and 74. The second drawer channels 76, 78 define guide rails 76′ and 78′ respectively, which are adapted to provide sliding support for drawer slides formed integral with the side flanges 48 of the drawer. Means defining third outwardly facing channels 82, 84 are formed in the frame side members 62, 64 respectively, intermediate each of the first and second channels. In addition, means defining inwardly facing left 86 and right 88 side grooves are formed in the frame side members 62, 64 respectively, adjacent the lower portion or bottom of the frame.

As seen in FIG. 2, the frame rear cross member 68 has a substantially coextensive transverse seal retaining member 87 suitably secured along the lower portion of the member 68 to provide a forwardly facing rear groove 89. In the form shown member 68 has its free edge solvent welded in upwardly facing groove 99 of member 87. The side grooves 86 and 88 are configured for retaining side seals 90, 91 therein while the rear groove 89 retains a rear seal 93. The side seals 90, 91 and rear seal 93 each include a main body portion 92, shown held in their associated groove by barbs integrally formed in the grooves, and a lip portion 94 projecting toward the drawer. The lip portion 94 of the side seals is of a thickness and arcuate shape such that it will flex downwardly into tight sealing contact with the drawer side walls 47 and rear wall 46. Rear seal 93, shown in the preferred embodiment as identical to the side seals, is positioned with its lip portion 94 operative to sealingly engage the drawer rear wall 46 upon closure of the drawer 44. The seals 90, 91 and 93 are preferably made of a material, such as extruded polyvinyl chloride, having a hardness of the order of 78±5 Shore D durometer.

Thus, the seal means of the disclosed embodiment is composed of separate right 90 and left 91 side seals and rear seal 93, each of which has a lip portion 94 extending into the path of the drawer 44 when the drawer is moved from its open position to its closed position. As a result when the drawer 44 is in its closed position the rear seal 93 and the right 91 and left 90 side seals abut the rear wall 46 and side walls 47 of the drawer, respectively, in a manner to partially form a generally airtight seal therewith.

With reference to FIG. 4, the front cross frame member 66 includes a downwardly extending flange 104 with seal means fixed thereon for effecting a sealed relationship with the inner face of drawer front wall 45 when the drawer is in its closed position. In the preferred form, the seal means is in the form of a rectangular sectioned sponge-like seal 106 which is suitably secured to the outer face of the flange 104 arranged to sealingly contact the front wall of the drawer when the drawer is in its closed position to complete the generally airtight seal environment for the food stored in the drawer.

As seen in FIGS. 3–6, the left side trim member 52 has a generally C-shaped cross section formed by upper 96 and lower 97 legs joined by a bight portion 98, with each upper leg 96 overlapping an upper face of its associated frame side member and each lower leg 97 overlapping an upper notched wall portion 101 of its associated third channel 82 and 84 in a manner for grippingly retaining the trim members in a fixed relation thereto. The right side trim member 54 is a mirror image of trim member 52 with its corresponding parts indicated by primes. The upper legs 96 and 96′ of the trim members 52 and 54, include stop tab portions 102 which are bent downwardly at substantially right angles to the plane of the legs. In this manner the top portions are located to provide interfering relationship with the rearward travel of the cover panel 50 in the first channels 72, 74 thus cooperating with the shoulder means 75 which position the panel's forward edge, to lock the cover panel 50 in the frame 42. It will be noted that while under normal usage a single tab 102 on one of the trim members would be sufficient to retain the panel, for purposes of shipping or other stress situations it is preferable to have both tabs 102 and 102′ secure the panel.

As seen in FIG. 2, with the drawer fully closed its front wall 45 is spaced from the frame front edges. The frame left side front edge is shown at 112 formed by raised flared guide section 114, defining frame left side offset stop 116 leading into the channels 76. An identical construction is provided for the right-side channel 78. The frame left and right hand stops 116 are positioned such that upon the drawer being pulled about half-way out the stops 116 engage the forward edges 117 of drawer flange slides 118 to prevent accidental removal of the drawer. It will be noted that the cover channels 76 and 78 are angled upwardly at 119 to allow the partially withdrawn drawer to be canted upwardly to allow the drawer slide edges 117 to clear the frame stops 116; for removal of the drawer.

Figure 6:
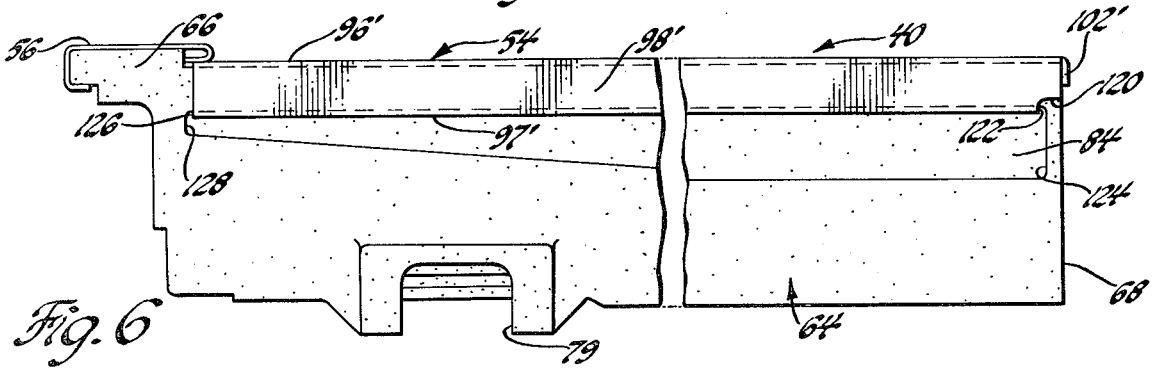
FIG. 6 is an enlarged side elevational view of the one-piece frame member showing one side trim member.

It will be seen in FIG. 6 that each trim strip 52 and 54 is prevented from moving longitudinally by means of a notch indicated at 120 formed in the rearward end of trim strip 54. The notch 120 defines a recessed free edge 122 which is adapted to abut the aft vertical surface 124 of channel 84. The forward edge of the side trim strip's lower legs 97 and 97' are adapted to abut the forward vertical surface of their associated channel as shown by forward edge 126 of leg 97' and surface 128 of channel 84.

While the embodiment of the present invention as herein disclosed constitutes a preferred form, it is to be understood that other forms might be adopted.

The embodiments of the invention in which an exclusive property or privilege is claimed are defined as follows:

1. A supporting frame and cover panel assembly adapted for slidably and sealingly supporting a flanged, imperforate open top food storage drawer between an open position outside the frame providing access to the food therein and a closed position inside the frame providing a generally airtight sealed environment for the food therein; said assembly including a rectangular one-piece frame, a cover panel of similar rectangular shape and a pair of trim members for affixing the cover panel in said frame, said one-piece frame comprising elongated mirror image side frame members interconnected at their ends by front and rear cross frame members, means defining first inwardly facing channels adjacent the top of said side frame members and extending throughout the length thereof for slidably receiving opposite sides of said cover panel therein, shoulder means on said front cross member abutting said cover panel as it is slidably received in said first channels for positioning said cover panel in said frame, means defining second inwardly facing channels in said side frame members substantially coextensive with said spaced below said first channels, said second channels adapted to provide sliding support for an associated flange of the drawer, means defining a third outwardly facing channel intermediate each said first and second channels and defined thereby, and means defining an inwardly facing groove adjacent the bottom of said side frame members configured for receiving and affixing one portion of a seal for said drawer, each of said pair of trim members having a generally C-shaped section formed by upper and lower legs, each upper leg overlapping an upper face of its associated side frame member and each lower leg overlapping an upper wall portion of its associated third channel in a manner for grippingly retaining the trim member in affixed relationship thereto, the upper leg of at least one trim member including an integral stop tab portion operative to provide interfering relationship with the rearward travel of said cover panel in the first channels to lock said cover panel in said frame in conjunction with said shoulder means, a seal support member on said rear cross frame member defining a forwardly facing groove in substantial alignment with the grooves on said side frame members and configured for receiving and affixing another portion of said seal for said drawer, and a seal affixed in the grooves of said side members and said seal support member and substantially coextensive therewith, said seal extending into the path of said drawer when said drawer is moving from its open position to its closed position, whereby when the drawer is in its closed position said seal portions abut the side and rear walls of said drawer in a manner to partially form a generally airtight seal therewith; said front cross frame member including means for effecting a sealed relationship with the front wall of said drawer when said drawer is in its closed position to complete the generally airtight sealed environment for the food in said drawer.

* * * * *